US012421956B2

(12) United States Patent
Shook et al.

(10) Patent No.: US 12,421,956 B2
(45) Date of Patent: Sep. 23, 2025

(54) VARIABLE DISPLACEMENT PUMPS WITH FIXED AND ACTIVE DISPLACEMENT CONTROL MODES

(71) Applicant: Hamilton Sundstrand Corporation, Charlotte, NC (US)

(72) Inventors: Ryan Shook, Rockford, IL (US); Ryan Prescott Susca, Windsor, CT (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 205 days.

(21) Appl. No.: 18/074,807

(22) Filed: Dec. 5, 2022

(65) Prior Publication Data

US 2024/0183352 A1 Jun. 6, 2024

(51) Int. Cl.
*F04B 49/22* (2006.01)
*F04B 1/295* (2020.01)
*F04B 1/324* (2020.01)

(52) U.S. Cl.
CPC ..... *F04B 49/22* (2013.01); *F04B 1/295* (2013.01); *F04B 1/324* (2013.01)

(58) Field of Classification Search
CPC ..... F04B 1/295; F04B 1/324; F04B 49/002; F04B 49/22
See application file for complete search history.

(56) References Cited

U.S. PATENT DOCUMENTS 3,302,585 A * 2/1967 Adams ..... F01B 3/106 417/217
3,768,928 A * 10/1973 Miller ..... F04B 1/324 60/451
3,864,063 A * 2/1975 Martin ..... F04B 49/08 417/222.1
4,229,144 A * 10/1980 Kass ..... F15B 13/16 417/269
4,480,438 A * 11/1984 Breeden ..... F16H 61/439 60/389
4,512,723 A * 4/1985 Williams ..... F16H 61/46 60/452
4,715,788 A * 12/1987 Kouns ..... F04B 1/324 60/443
6,374,722 B1 4/2002 Du et al.
6,725,658 B1 * 4/2004 Lemmen ..... F04B 1/324 60/443

(Continued)

FOREIGN PATENT DOCUMENTS

CN 108474364 A * 8/2018 ..... F04B 1/20
DE 3200126 A1 7/1983

(Continued)

OTHER PUBLICATIONS

Extended European Search Report for EP Application No. 23214265.3, Dated Apr. 23, 2024, pp. 6.

*Primary Examiner* — Alexander B Comley
(74) *Attorney, Agent, or Firm* — Kinney & Lange, P.A.

(57) ABSTRACT

A system includes a variable displacement pump (VDP) having a pump inlet, a pump outlet, and a pump control line configured to receive a control pressure to actuate a variable displacement mechanism of the VDP. A controller is operatively connected to the pump control line to actively control actuation of the variable displacement mechanism in a first mode for variable displacement pumping and in a second mode for fixed displacement pumping.

20 Claims, 2 Drawing Sheets

(56) References Cited

U.S. PATENT DOCUMENTS

| | | | | |
|---|---|---|---|---|
| 6,996,969 | B2 | 2/2006 | Dalton | |
| 8,348,630 | B2 * | 1/2013 | Tysver | F02C 9/30 417/220 |
| 8,869,509 | B2 * | 10/2014 | Baker | F04B 49/22 60/424 |
| 9,617,923 | B2 | 4/2017 | Griffiths | |
| 10,767,667 | B2 * | 9/2020 | Guo | F15B 11/17 |
| 11,377,823 | B1 | 7/2022 | Quinn et al. | |
| 2010/0199838 | A1 * | 8/2010 | Krebs | F04B 1/2014 417/269 |
| 2015/0050165 | A1 * | 2/2015 | Zavadinka | F04B 49/002 417/270 |
| 2015/0285214 | A1 * | 10/2015 | Thoms | F16H 61/42 91/422 |
| 2019/0136851 | A1 * | 5/2019 | Sakai | E02F 9/2232 |
| 2021/0040944 | A1 * | 2/2021 | Smolka | F04B 49/002 |
| 2021/0270258 | A1 * | 9/2021 | Shand | F04B 49/06 |
| 2022/0307491 | A1 * | 9/2022 | Rutar | F04B 49/065 |

FOREIGN PATENT DOCUMENTS

| | | | | |
|---|---|---|---|---|
| DE | 3629638 | A1 * | 3/1987 | |
| DE | 3200126 | C2 * | 6/1988 | |
| DE | 102016214425 | A1 * | 3/2017 | |
| JP | H07714 | Y2 * | 1/1995 | |
| JP | 4806500 | B2 * | 11/2011 | F04B 1/324 |
| WO | WO-2017063798 | A1 * | 4/2017 | |
| WO | WO-2020195299 | A1 * | 10/2020 | F04B 1/26 |

* cited by examiner

VARIABLE DISPLACEMENT PUMPS WITH FIXED AND ACTIVE DISPLACEMENT CONTROL MODES

BACKGROUND

1. Field

The present disclosure relates to pump control, and more particularly to control for variable displacement pumps (VDPs).

2. Description of Related Art

In a pump, the turn-down ratio is the ratio of the pump's maximum flow to its minimum flow. In fuel delivery systems using a variable displacement pump (VDP), often the pump is subject to a high turn-down ratio. This can drive a pump design with a less than optimal pump efficiency throughout the operating range as a tradeoff for ensuring the turn-down ratio needed. For example, it is beneficial to pump design to minimize this turn-down ratio to be less than 4:1.

The conventional techniques have been considered satisfactory for their intended purpose. However, there is an ever present need for improved systems and methods for improved pump operation including improved tradeoff between turn-down ratio and efficiency throughout the operating range. This disclosure provides a solution for this need.

SUMMARY

A system includes a variable displacement pump (VDP) having a pump inlet, a pump outlet, and a pump control line configured to receive a control pressure to actuate a variable displacement mechanism of the VDP. A controller is operatively connected to the pump control line to actively control actuation of the variable displacement mechanism in a first mode for variable displacement pumping and in a second mode for fixed displacement pumping.

The controller can include a pressure regulating valve (PRV) operatively connected to the pump inlet and to the pump outlet to control recirculation from the pump outlet to the pump inlet in the second mode for fixed displacement pumping. The controller can control the variable displacement mechanism to have a fixed displacement in the second mode.

The controller can include an electrohydraulic servo valve (EHSV) that connects to the pump control line in the first mode, and to the PRV in the second mode. A transfer valve can be operatively connected to the pump control line. The transfer valve can be connected to a control line of the PRV. The transfer valve can be connected to an outlet line of the EHSV. The transfer valve can be operative to switch between connecting the outlet line of the EHSV to the pump control line in the first mode, and connecting the outlet line of the EHSV to the control line of the PRV in the second mode.

The PRV can include a piston configured to move against a bias based on a difference in pressure between the control line of the PRV and a first connection line to the pump outlet. The PRV can include a second connection line to the pump outlet. The PRV can include a recirculation line connected to the pump inlet. The piston can be configured to vary flow from the second connection line, through the PRV to the recirculation line based on position of the piston within a sleeve of the PRV. The control line of the PRV can connect to the recirculation line and to the pump inlet through a fixed throttle so the PRV control line is pressurized by pressure of the pump outlet in the first mode, and by the pump inlet in the second mode.

A solenoid valve can be connected to a first line connected to the pump outlet, and connected to a second line connected through a fixed throttle to the pump inlet. A first end of a piston of the transfer valve can be connected to the second line at a position between the solenoid valve and the fixed throttle. A second end of the piston of the transfer valve can be connected to the first line. In the first mode, the solenoid valve can be energized to connect the pump outlet to the first end of the piston of the transfer valve. In the second mode, the solenoid valve can be de-energized to connect pressure of the pump inlet through the fixed throttle to the first end of the piston of the transfer valve.

The VDP can include a sensor connected to determine position of the displacement mechanism. The sensor can be connected to provide feedback to a control logic operatively connected to switch the solenoid valve between the first mode and the second mode based at least in part on the feedback from the sensor. A shutoff valve can be connected to the pump outlet and to the pump inlet through a fixed throttle. The shutoff valve can be configured to shutoff output from the pump to an external system fed by the pump. A solenoid valve can be operatively connected to an input line of the shutoff valve, wherein the solenoid valve is configured to allow output from the pump to the external system in a de-energized state and to shutoff flow to the external system through the shutoff valve in an energized state.

A method of pump control includes over a first pressure range, controlling a variable displacement pump (VDP) in a first mode to have variable displacement. The method includes switching to control of the VDP to a second mode for fixed displacement over a second pressure range that is lower than the first pressure range. A top end of the first pressure range P1, and a low end of the second pressure range P2 can provide a turndown ratio P1/P2 of at least 4:1.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
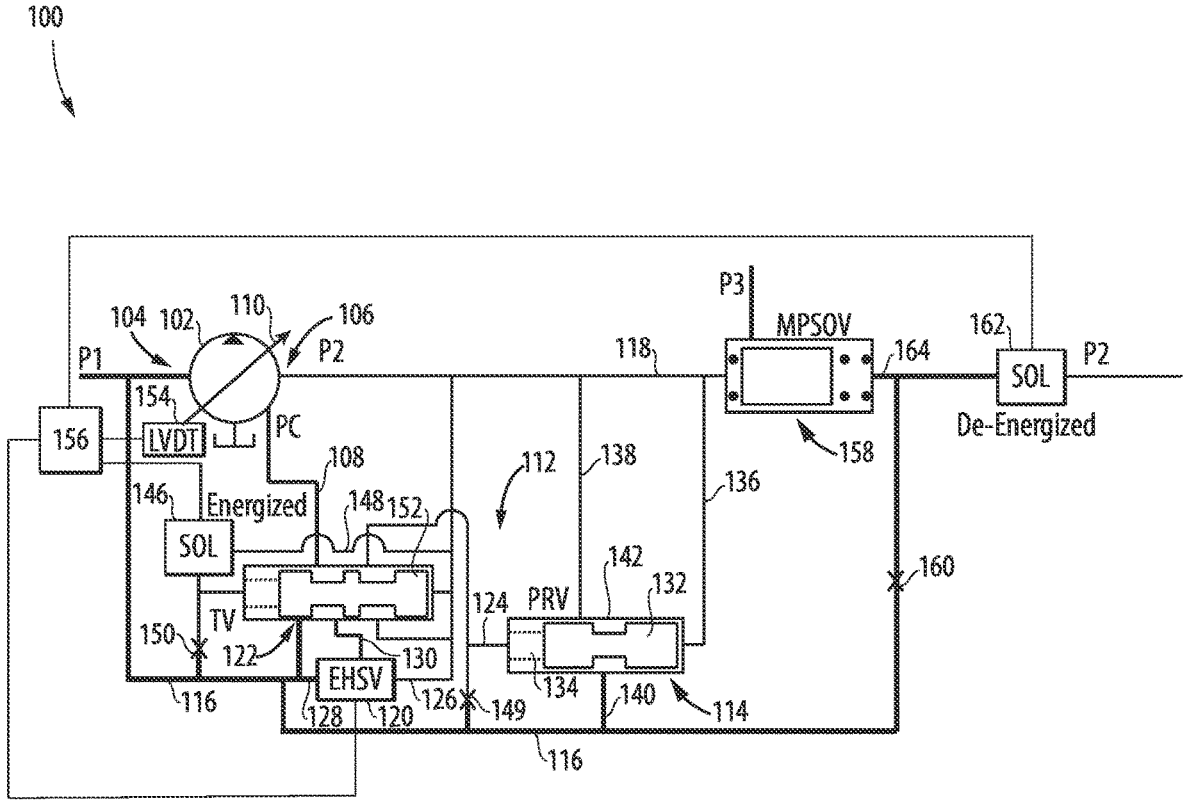
FIG. 1 is a schematic view of an embodiment of a system constructed in accordance with the present disclosure, showing the first mode for variable displacement pumping.

Reference will now be made to the drawings wherein like reference numerals identify similar structural features or aspects of the subject disclosure. For purposes of explanation and illustration, and not limitation, a partial view of an embodiment of a system in accordance with the disclosure is shown in FIG. 1 and is designated generally by reference character 100. Other embodiments of systems in accordance with the disclosure, or aspects thereof, are provided in FIG. 2, as will be described. The systems and methods described herein can be used to for fixed and active displacement control of variable displacement pumps (VDPs), which can provide for high turndown ratios, for example in fuel systems of aircraft.

The system 100 includes a variable displacement pump (VDP) 102 having a pump inlet 104, a pump outlet 106, and a pump control line 108 configured to receive a control pressure to actuate a variable displacement mechanism 110 of the VDP 102. A controller 112 is operatively connected to the pump control line 108 to actively control actuation of the variable displacement mechanism 110 in a first mode, shown in FIG. 1, for variable displacement pumping and in a second mode, shown in FIG. 2, for fixed displacement pumping.

Figure 2:
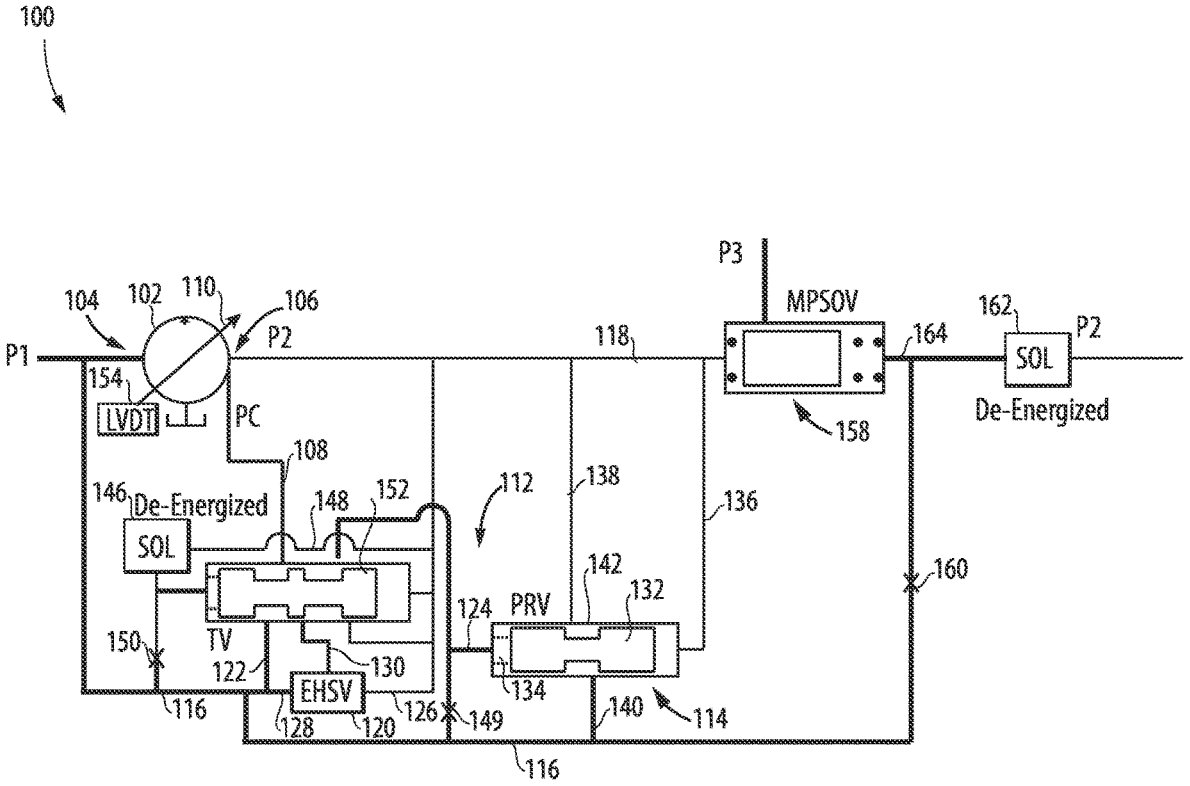
FIG. 2 is a schematic view of the system of FIG. 1, showing the second mode for fixed displacement pumping.

The controller 112 includes a pressure regulating valve (PRV) 114 operatively connected to the pump inlet 104 by a line 116, and to the pump outlet 106 by a line 118, to control recirculation from the pump outlet 106 to the pump inlet 104 in the second mode for fixed displacement pumping, as shown in FIG. 2. The controller 112 controls the variable displacement mechanism 110 to have a fixed displacement in the second mode.

The controller 112 includes an electrohydraulic servo valve (EHSV) 120 that connects to the pump control line 108 in the first mode shown in FIG. 1, and to the PRV 114 in the second mode, shown in FIG. 2. A transfer valve 122 is operatively connected to the pump control line 108. The transfer valve 122 is connected to a control line 124 of the PRV 114. The transfer valve 122 is connected to an outlet side line 126 of the EHSV 120 and to an inlet side line 128 of the EHSV 120 for supplying pressurized fluid to the EHSV 120 for its operation. The EHSV has an outlet line 130. The transfer valve 122 is operative to switch between connecting the outlet line 130 of the EHSV 120 to the pump control line 108 in the first mode as shown in FIG. 1, and connecting the outlet line 130 of the EHSV 120 to the control line 124 of the PRV 114 in the second mode as shown in FIG. 2.

The PRV 114 includes a piston 132 configured to move against a bias, e.g. spring 134, based on a difference in pressure between the control line 124 of the PRV and a first connection line 136 to the pump outlet 106. The PRV 114 includes a second connection line 138 to the pump outlet 106. The PRV 114 includes a recirculation line 140 connected to the pump inlet 104. The piston 132 is configured to vary flow from the second connection line 138, through the PRV 114 to the recirculation line 140 based on position of the piston 132 within a sleeve 142 of the PRV 114. The control line 124 of the PRV connects to the recirculation line 140 and to the pump inlet 104 through a fixed throttle or orifice 149 so the PRV control line 124 is pressurized by pressure of the pump outlet 106 in the first mode shown in FIG. 1, and by the pump inlet 104 in the second mode shown in FIG. 2.

A solenoid valve 146 is connected to a first line 148 connected to the pump outlet 106, and connected to a second line 116 connected through a fixed throttle or orifice 150 to the pump inlet 104. A first end of a piston 152, i.e. the left end as oriented in FIG. 1, of the transfer valve 122 is connected to the second line 116 at a position between the solenoid valve 146 and the fixed throttle 150. A second end of the piston 152, as oriented in FIG. 1, is connected to the first line 148. In the first mode shown in FIG. 1, the solenoid valve 146 is energized to connect the pump outlet 106 to the first end of the piston 152 of the transfer valve 122. In the second mode shown in FIG. 2, the solenoid valve 146 is de-energized to connect pressure of the pump inlet 104 through the fixed throttle 150 to the first end of the piston 152 of the transfer valve 122. Those skilled in the art will readily appreciate that the same function and states can be achieved even if the solenoid valve 146 is de-energized in the first state of FIG. 1 and energized for the second state of FIG. 2.

The VDP 102 includes a sensor 154, such as a linear variable displacement transducer (LVDT), connected to determine position of the displacement mechanism 110. The sensor 154 is connected to provide feedback to a control logic 156 operatively connected to switch the solenoid 146 between the first mode and the second mode based at least in part on the feedback from the sensor 154. A shutoff valve 158, e.g. a minimum pressure and shutoff valve (MPSOV) is connected to the pump outlet 106 and is connected to the pump inlet 104 through a fixed throttle or orifice 160. The shutoff valve 158 is configured to shutoff output from the pump 102 to an external system indicated in FIGS. 1 and 2 by pressure P3, which is fed by the pump 102. A solenoid valve 162 is operatively connected to an input line 164 of the shutoff valve 158, wherein the solenoid 162 is configured to allow output from the pump 102 to the external system (at P3) in a de-energized state and to shutoff flow to the external system through the shutoff valve 158 in an energized state. Those skilled in the art will readily appreciate that these energized/de-energized states can be reversed to still have the same effect if desired.

A method of pump control includes over a first pressure range, controlling a variable displacement pump (VDP) in a first mode, as shown in FIG. 1, to have variable displacement. The method includes switching to control of the VDP to a second mode, as shown in FIG. 2, for fixed displacement over a second pressure range that is lower than the first pressure range. The top end of the first pressure range P1, and the low end of the second pressure range P2 can provide a turndown ratio P1/P2 of at least 4:1.

Utilizing a variable displacement pump with two means of displacement control, fixed and active, a pump's turndown ratio can be reduced by increasing the minimum flow set point. For conditions where flow demand is less than pump minimum EHSV that controls pump displacement is disengaged from the pump via a transfer valve, setting the pump to min flow and a PRV is used to bypass the excess flow. For conditions where flow demand is more than pump minimum the transfer valve state is changed, allowing EHSV control of the pump and the PRV is driven closed. This provides potential benefits including increased pump efficiency and reduced temperature rise.

The pump's turn down ratio can be decreased, so there will be more bypass flow at the pump's minimum displacement, but the pump will be more efficient when operating in variable displacement mode. The design goal can be to have the minimum displacement be less than the minimum displacement required for cruise power settings in an aircraft, for example. So the pump will be in variable displacement mode for cruise, helping to optimize high pressure extracting. Conditions like start and idle the fixed displacement mode can be active and the pump may not be as efficient but the savings at cruise will typically outweigh loses at idle when total time at each condition is considered.

The methods and systems of the present disclosure, as described above and shown in the drawings, provide for fixed and active displacement control of VDPs, which can provide for high turndown ratios, for example in fuel systems of aircraft. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A system comprising:

a variable displacement pump (VDP) having a pump inlet, a pump outlet, and a pump control line configured to receive a control pressure to actuate a variable displacement mechanism of the VDP; and a controller operatively connected to the pump control line to actively control actuation of the variable displacement mechanism in a first mode for variable displacement pumping and in a second mode for fixed displacement pumping, wherein the controller comprises:

a pressure regulating valve (PRV) operatively connected to the pump inlet and to the pump outlet to control recirculation from the pump outlet to the pump inlet in the second mode for fixed displacement pumping, wherein the controller controls the variable displacement mechanism to have a fixed displacement in the second mode;

an electrohydraulic servo valve (EHSV) that connects to the pump control line in the first mode, and to the PRV in the second mode; and a transfer valve operatively connected to the pump control line, wherein the transfer valve is connected to a control line of the PRV, and wherein the transfer valve is connected to an outlet line of the EHSV, and wherein the transfer valve is operative to switch between connecting the outlet line of the EHSV to the pump control line in the first mode, and connecting the outlet line of the EHSV to the control line of the PRV in the second mode.

2. The system as recited in claim 1, wherein the PRV includes a piston configured to move against a bias based on a difference in pressure between the control line of the PRV and a first connection line to the pump outlet.

3. The system as recited in claim 2, wherein the PRV includes a second connection line to the pump outlet, wherein the PRV includes a recirculation line connected to the pump inlet, and wherein the piston is configured to vary flow from the second connection line, through the PRV to the recirculation line based on a position of the piston within a sleeve of the PRV.

4. The system as recited in claim 3, wherein the control line of the PRV connects to the recirculation line and to the pump inlet through a fixed throttle so the control line of the PRV is pressurized by pressure of the pump outlet in the first mode, and by the pump inlet in the second mode.

5. The system as recited in claim 1, further comprising:

a solenoid valve connected to a first line connected to the pump outlet, and connected to a second line connected through a fixed throttle to the pump inlet.

6. The system as recited in claim 5, wherein a first end of a piston of the transfer valve is connected to the second line at a position between the solenoid valve and the fixed throttle.

7. The system as recited in claim 6, wherein a second end of the piston of the transfer valve is connected to the first line.

8. The system as recited in claim 7, wherein in the first mode, the solenoid valve is energized to connect the pump outlet to the first end of the piston of the transfer valve.

9. The system as recited in claim 8, wherein, in the second mode, the solenoid valve is de-energized to connect pressure of the pump inlet through the fixed throttle to the first end of the piston of the transfer valve.

10. The system as recited in claim 9, wherein the VDP includes a sensor connected to determine a position of the displacement mechanism, wherein the sensor is connected to provide feedback to a control logic operatively connected to switch the solenoid valve between the first mode and the second mode based at least in part on the feedback from the sensor.

11. The system as recited in claim 1, further comprising a shutoff valve connected to the pump outlet and to the pump inlet through a fixed throttle, wherein the shutoff valve is configured to shutoff output from the VDP to an external system fed by the VDP.

12. The system as recited in claim 11, further comprising a solenoid valve operatively connected to an input line of the shutoff valve, wherein the solenoid valve is configured to allow output from the VDP to the external system in a de-energized state and to shutoff flow to the external system through the shutoff valve in an energized state.

13. A system comprising:

a variable displacement pump (VDP) having a pump inlet, a pump outlet, and a pump control line configured to receive a control pressure to actuate a variable displacement mechanism of the VDP in a first mode for variable displacement pumping and in a second mode for fixed displacement pumping;

a pressure regulating valve (PRV) operatively connected to the pump inlet and to the pump outlet to control recirculation from the pump outlet to the pump inlet;

an electrohydraulic servo valve (EHSV) that connects to the pump control line in the first mode, and to the PRV in the second mode; and a transfer valve operatively connected to the pump control line, wherein the transfer valve is connected to a control line of the PRV, and wherein the transfer valve is connected to an outlet line of the EHSV, and wherein the transfer valve is operative to switch between connecting the outlet line of the EHSV to the pump control line in the first mode, and connecting the outlet line of the EHSV to the control line of the PRV in the second mode.

14. The system as recited in claim 13, wherein the PRV includes a piston configured to move against a bias based on a difference in pressure between the control line of the PRV and a first connection line to the pump outlet.

15. The system as recited in claim 14, wherein the PRV includes a second connection line to the pump outlet, wherein the PRV includes a recirculation line connected to the pump inlet, and wherein the piston is configured to vary flow from the second connection line, through the PRV to the recirculation line based on position of the piston within a sleeve of the PRV.

16. The system as recited in claim 15, wherein the control line of the PRV connects to the recirculation line and to the pump inlet through a first fixed throttle so the control line of the PRV is pressurized by pressure of the pump outlet in the first mode, and by the pump inlet in the second mode.

17. The system as recited in claim 16, further comprising:

a solenoid valve connected to a first line connected to the pump outlet, and connected to a second line connected through a second fixed throttle to the pump inlet.

18. The system as recited in claim 17, wherein a first end of a piston of the transfer valve is fluidically connected to the second line at a position between the solenoid valve and the second fixed throttle.

19. The system as recited in claim 18, wherein a second end of the piston of the transfer valve is fluidically connected to the first line.

20. The system as recited in claim 19, wherein in the first mode the solenoid valve is energized to connect the pump outlet to the first end of the piston of the transfer valve, and in the second mode the solenoid valve is de-energized to connect pressure of the pump inlet through the fixed throttle to the first end of the piston of the transfer valve.

* * * * *